US006109184A

United States Patent [19]

Wech

[11] Patent Number: 6,109,184

[45] Date of Patent: Aug. 29, 2000

[54] COOLING ARRANGEMENT IN A FOLDING ASSEMBLY AND COOLING PROCESS

[75] Inventor: Erich Wech, Augsburg, Germany

[73] Assignee: MAN Roland Druckmaschinen AG, Offenbach am Main, Germany

[21] Appl. No.: 09/237,363

[22] Filed: Jan. 26, 1999

[30] Foreign Application Priority Data

Jan. 26, 1998 [DE] Germany ..... 198 02 739

[51] Int. Cl.[7] ..... B41F 23/04; B41F 13/54

[52] U.S. Cl. ..... 101/487; 101/417; 101/228

[58] Field of Search ..... 101/416.1, 424.1, 101/487, 488, 232, 219, 228, 417

[56] References Cited

U.S. PATENT DOCUMENTS

| | | | |
|---|---|---|---|
| 2,334,628 | 11/1943 | Huck et al. | 101/219 |
| 3,056,593 | 10/1962 | Timson | 263/3 |
| 3,060,853 | 10/1962 | Remer | 101/426 |
| 3,312,126 | 4/1967 | Hering | 74/675 |
| 4,187,968 | 2/1980 | Winterholler et al. | 226/92 |
| 5,947,026 | 9/1999 | Murray et al. | 101/416.1 |

FOREIGN PATENT DOCUMENTS

| | | | |
|---|---|---|---|
| 0 747 310 | 5/1996 | European Pat. Off. | B65H 27/00 |
| 643201 | 4/1935 | Germany | B41F 22/04 |
| 1 873 638 | 3/1963 | Germany . | |
| 31 28 430 | 1/1983 | Germany | B41F 23/08 |
| 58-212558 | 6/1982 | Japan | B65H 45/02 |

*Primary Examiner*—Kimberly Asher
*Attorney, Agent, or Firm*—Cohen, Pontani, Lieberman & Pavane

[57] ABSTRACT

A folding device in which printing-material webs are cooled in an effective manner includes guide rollers and/or feed rollers designed as cooling rollers. Alternatively or in conjunction with the cooling rollers, there are cooling arrangements in the folder superstructure and compressed cooling air flows from these cooling arrangements onto the surfaces of the printing-material webs.

13 Claims, 3 Drawing Sheets

COOLING ARRANGEMENT IN A FOLDING ASSEMBLY AND COOLING PROCESS

BACKGROUND OF THE INVENTION

1. Field of the Invention

The invention relates to a folding assembly in a rotary printing machine with guide rollers and feed rollers for transporting a printing-material web.

2. Description of the Related Art

German reference DE 31 28 430 C2 has already disclosed a web-fed rotary printing machine in which a printing-material web is drawn in from a web-infeed unit and runs through a plurality of printing units one after the other for printing on both sides of the web. After passing through the printing units, the printing-material web that has been made wet by the printing ink is dried in a dryer. After being dried, the printing-material web is cooled in a cooling unit and fed, via a folder superstructure, to a folding unit, in which it is cut and folded in the conventional manner.

It has been found that the printing-material web has a tendency to assume the temperature of the ambient air surrounding it, or at least approach this temperature, as it is fed from the cooling unit to the folding unit. Because of the machinery running in printshops, which are generally insufficiently temperature-conditioned if at all, temperatures may reach above 30° C. Because of the above tendency of the printing-material web to at least approach the ambient temperatures, these elevated temperature conditions may result in the printing-material web likewise assuming temperatures above 30° C. If the printing ink, for example a so-called heat-set ink, assumes a temperature of 30° C. or above after leaving the dryer and the cooling unit, particles of the printing ink soften again. This, in turn, results in smearing of the printing ink on elements of the folding assembly and of the folding unit. The softening of the ink also may cause the products produced from the printing-material web, which are to be stacked, to stick to one another, which considerably adversely affects the printing quality.

SUMMARY OF THE INVENTION

It is an object of the present invention to counteract the adverse side effects in a prior art folding assembly in a web-fed rotary printing machine.

It is a further object of the present invention to ensure that no printing ink, in particular no heat-set ink, comes off of a printed printing-material web.

This object is achieved by a folding device of a web-fed rotary printing machine, including a turner-bar structure, a folding unit, and a plurality of rollers for guiding and feeding a printing-material web along a path through the turner-bar structure and to the folding unit, at least one of the plural rollers comprising a coolant roller operatively designed for conducting a coolant medium.

The object is also achieved by a folding device of a web-fed rotary printing machine, including a turner-bar structure, a folding unit, a plurality of rollers for guiding and feeding a printing-material web along a path through the turner-bar structure and to the folding unit, and a cooling arrangement operatively arranged along a path of the printing-material web for feeding a first cooling medium to the printing material web.

The object is also achieved by a cooling process for cooling a printing-material web that has been printed in printing units of a web-fed printing machine, dried in a dryer and preliminarily cooled in a cooling unit, including the steps of guiding the printing-material web through a folding device, and cooling the printing-material web within the folding device using a cooling arrangement comprising one of a cooling roller for conducting a first cooling medium and a cooling arrangement for feeding a second cooling medium to the printing-material web, such that no printing ink comes away from the printing material web According to the invention, the printing-material web is cooled in the region of a folding device to such an extent that it is prevented in an effective manner from exceeding a critical temperature at which the printed ink begins to come off of the printing material web.

The existing guide rollers and feed rollers of the folding device may be used for cooling the printing material web. However, it is also possible to install additional cooling elements into the folding device. If the folding device has a former, the printing material web may also be cooled in this portion of the folding device.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

A web-fed rotary printing machine which is constructed, for example, in the manner of the web-fed printing machine known from German reference DE 31 28 430 C2, has a folding device into which a printing-material web is guided after running through a dryer and a cooling unit of the printing machine.

Figure 1:
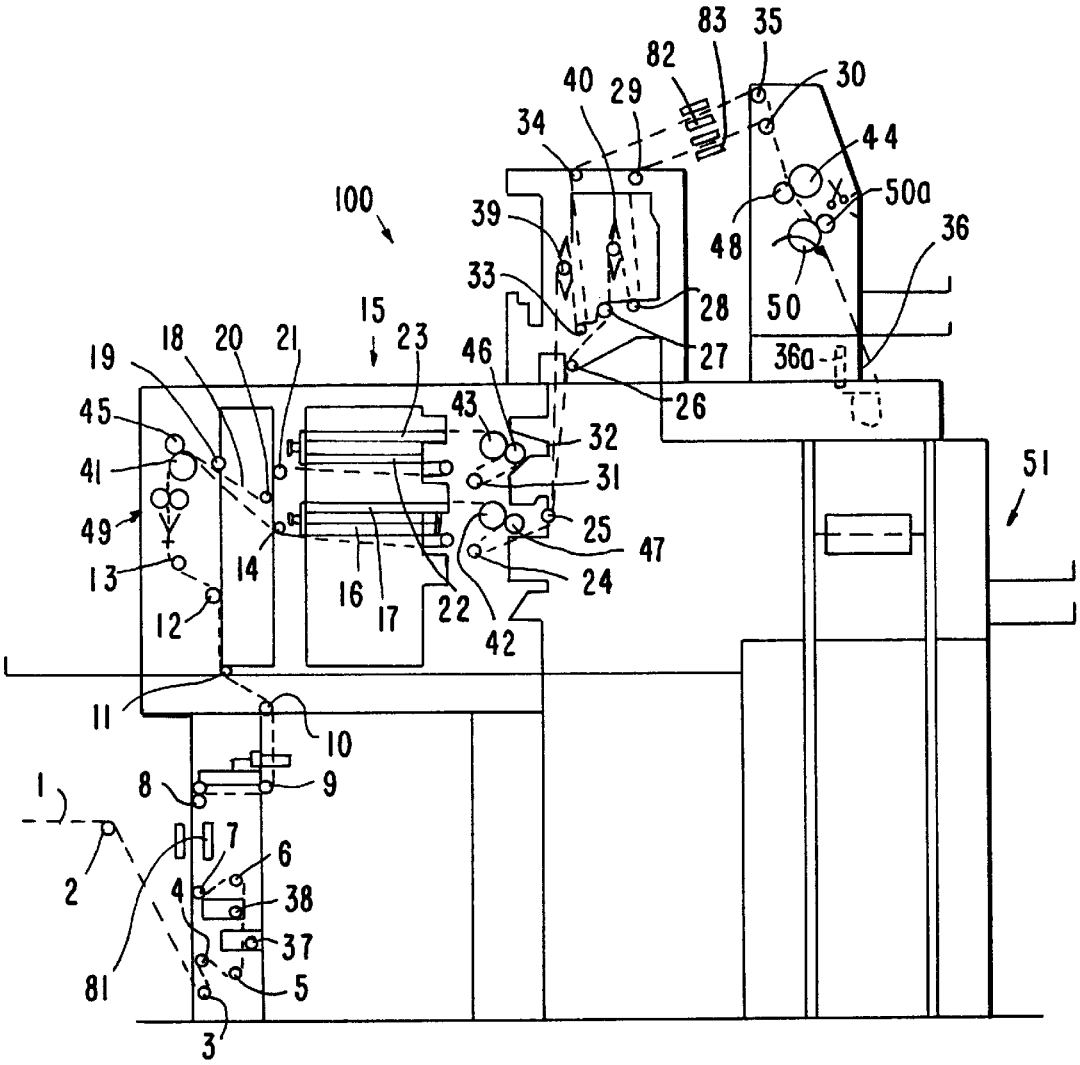
FIG. 1 is a longitudinal sectional view of a folding device according to an embodiment of the present invention.

Referring to FIG. 1, a printing-material web 1 that has passed through a cooling unit is fed to a folding device 100. The printing-material web 1 runs within the folding device 100 over deflecting rollers 2, 3, 4, 5, 6, 7, 8, 9, 10, 11, 12, 13, 14, some of which comprise guiding rollers and feed rollers. The printing-material web 1 is fed to a turner-bar structure 15 with turner and angle bars 16, 17. If a second printing-material web 18 is present, this is likewise fed over guide rollers 19, 20, 21 and over turner or angle bars 22, 23 of the turner-bar structure 15. After passing through the turner-bar structure 15, the printing-material web 1 is fed over further guide rollers 24, 25, 26, 27, 28, 29 and 30 to a former 36. If present, the second printing-material web 18 is likewise fed to the former 36 over guide rollers 31, 32, 33, 34, 35. In addition to the guide rollers 2 to 14, 19 to 21 and 24 to 35, there are further rollers for setting the longitudinal register or index of the printing-material webs 1, 18 in the folding device 100 such, for example, as the rollers 37, 38 at the entrance end of the folding device 100 and the rollers 39, 40 between the turner-bar structure 15 and the former 36.

Feed rollers 41, 42, 43, 44 and 50 respectively interact with pressure-exerting rollers 45, 46, 47, 48 and 50a to provide the printing-material web 1 or 18 with the necessary web tension. There are also guide-roller pairs with a top-cutter-forming roller and a further, bottom-cutter-forming roller such, for example, as the cutting-roller pair 49. The latter serves for cutting the printing-material webs 1 and 18 in a longitudinal direction.

After the printing-material webs 1 and 18 have been folded jointly by the former 36, they are fed into a folding unit 51 in which they are transversely cut and folded. The folding device 100 does not require the former 36. The folding device 100 may be designed without the former 36 so that the printing-material webs 1 and 18 are guided directly from the draw roller 50, and the associated pressure-exerting roller 50*a*, to the folding unit 51.

To counter the heating up effect that the ambient air has on the printing-material webs 1 and 18 after they have left the cooling unit, the printing-material webs 1 and 18 in the folding device, the present invention provides for at least one of the guide rollers 2 to 14, 19 to 21 and 24 to 35, over the path of the printing-material webs 1 and 18, to be designed as a cooling roller. For example, the guide rollers 14 and 20 and the guide rollers 30 and 35 may be designed as cooling rollers 73 (see FIG. 2). The feed rollers 41 to 44, 50 may also be designed as cooling rollers either on their own or in conjunction with the pressure-exerting rollers 45 to 48, 50*a*. Furthermore, one or more of the turner or angle bars 22, 23 of the turner-bar structure 15 may also be designed as the cooling rollers 73.

The guide rollers and/or feed rollers 2 to 14, 19 to 21 and 24 to 35, 41 to 44, 50 or pressure-exerting rollers 45 to 48, 50*a* , that may be designed as cooling rollers, are generally constructed in the same way as known cooling rollers. An example of a known cooling roller is disclosed in DE 29 27 198 A1. The coolant is often guided into the cooling roller via a rotary entry fitting.

Figure 2:
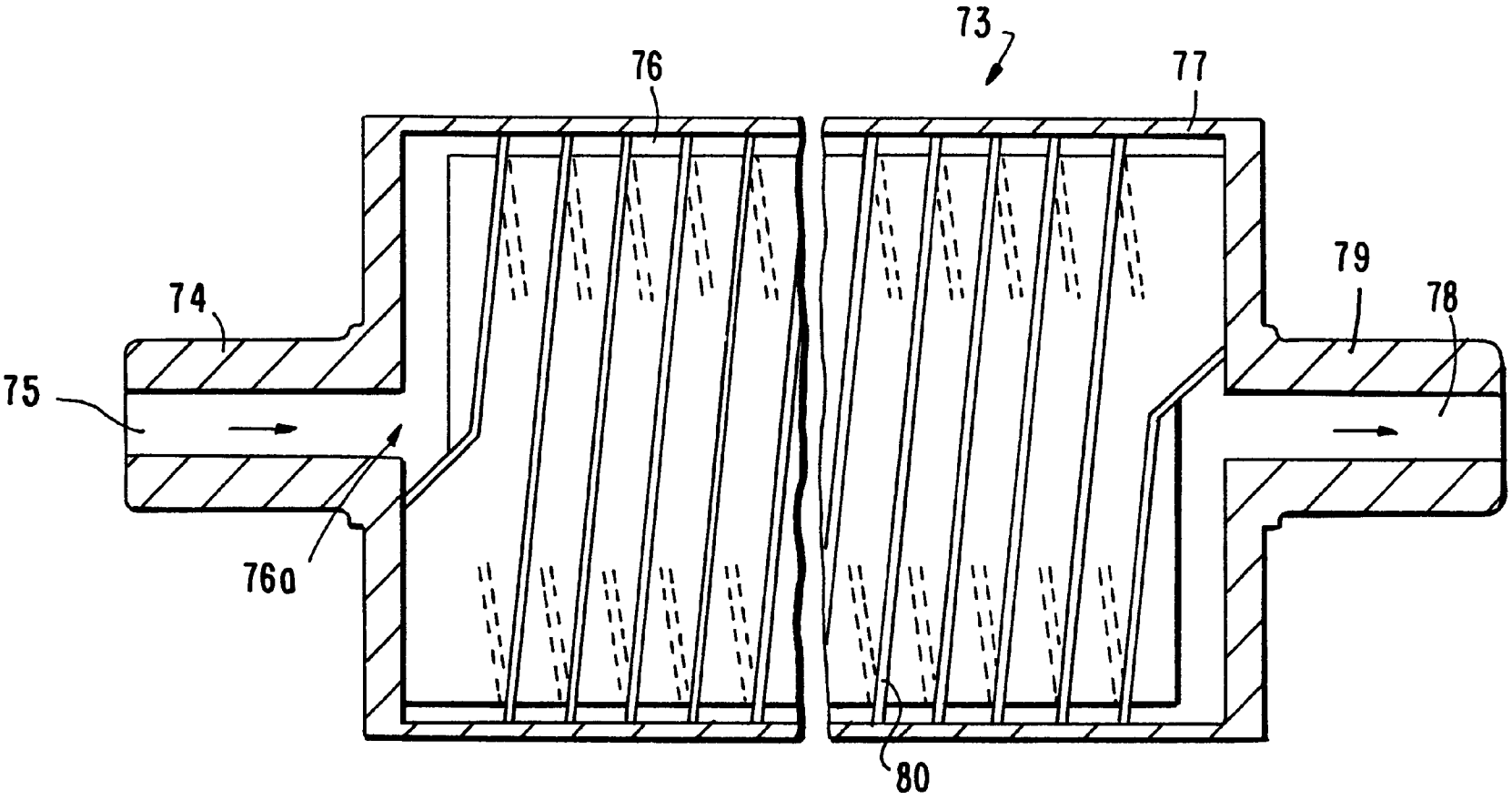
FIG. 2 is a longitudinal cross-section of a cooling roller of the folding device of FIG. 1.

An exemplary embodiment of a cooling roller 73 is shown in FIG. 2. An inflow tube 75 is arranged in the left-hand shaft journal 74 for feeding a coolant 76*a* to the cooling roller 73. The coolant 76a flows through an interspace 76 on the outside of the cylinder body 77 of the cooling roller 73 and flows out of an outflow tube 78 in the right-hand shaft journal 79 of the cooling roller 73. The flow of the coolant 76*a* within the interspace 76 is determined by a helically arranged baffle 80, which achieves the situation where the coolant 76*a* likewise flows helically through the interspace 76. This achieves good heat transfer between the outer wall of the cylinder body 77 and the coolant 76*a* in the interspace 76.

Figure 3:
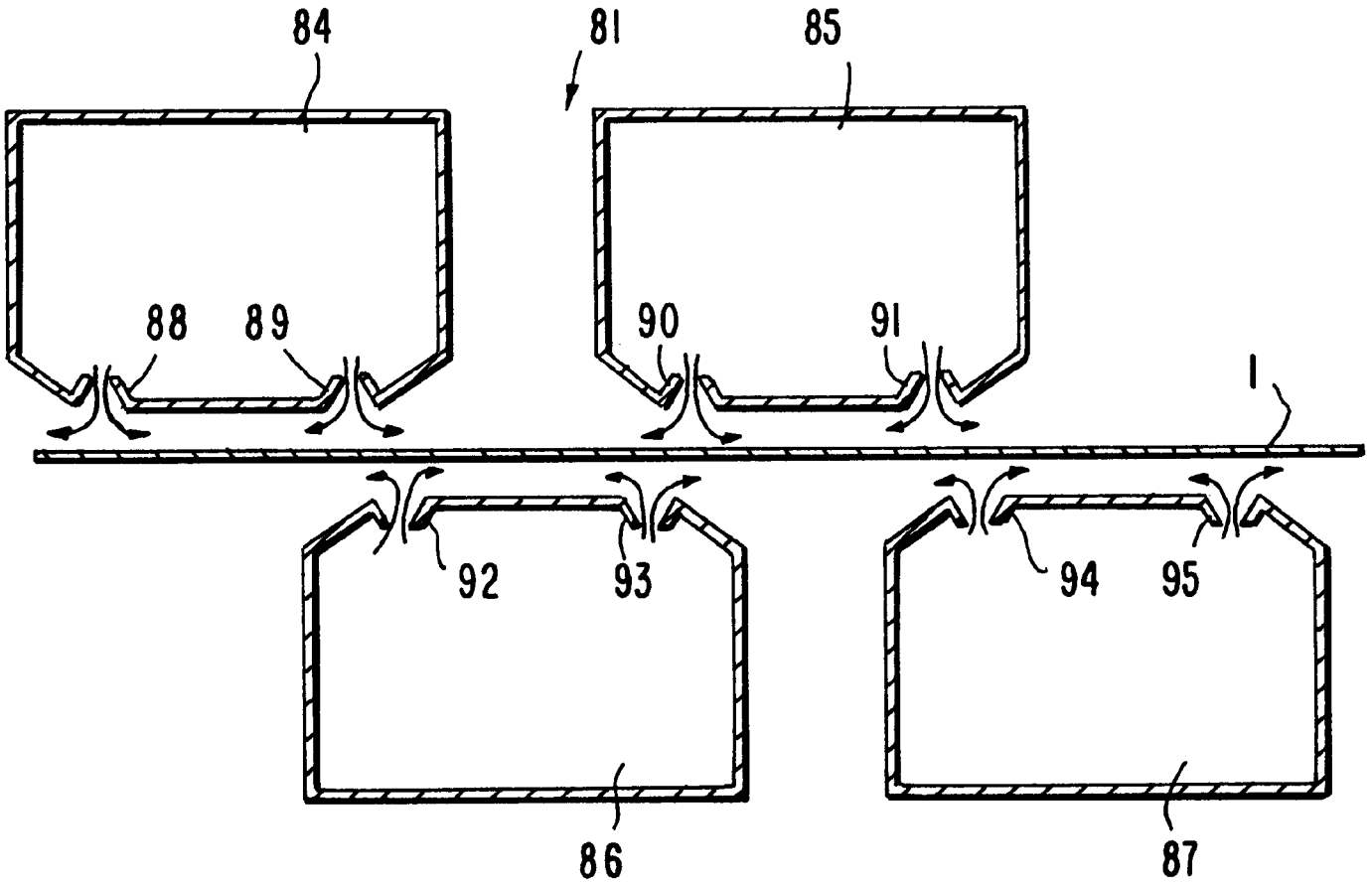
FIG. 3 is a sectional view of a cooling arrangement of the folding device of FIG. 1.

Cooling arrangements 81, 82 and 83 shown in the folding device 100 of FIG. 1 are provided additionally or alternatively to the guide rollers and draw rollers, designed as cooling rollers 73. The cooling arrangements are preferably provided on both sides of the printing-material webs 1 and 18. FIG. 3 is a more detailed view of the cooling arrangement 81. Each of the cooling arrangements 81 to 83 is similarly constructed. Referring to FIG. 3, the cooling arrangement 81 has four nozzle bars 84 to 87. Each of these nozzle bars 84 to 87 have openings 88 to 95 for discharging a cooling medium. The cooling medium passes out via the openings 88 to 95 and cools the printing-material web 1 along its surfaces on both sides.

The present invention provides a folding device 100 in which printing-material webs 1, 18 are effectively cooled. To achieve this result, guide rollers 2 to 14, 19 to 21, 24 to 35 and/or feed rollers 41 to 44 and 50 are designed as cooling rollers. Alternatively or in conjunction with the guide rollers 2 to 14, 19 to 21, 24 to 35 and/or feed rollers 41 to 44 and 50, which are designed as cooling rollers, cooling arrangements 81 to 83 are arranged in the folding device 100. A cooling medium such, for example, as compressed cooling air flows from these cooling arrangements onto the surfaces of the printing-material webs 1 and 18.

In addition, if the former 36 is present in the folding device 100, the printing-material webs 1, 18 may also be subjected to cooled compressed air by the compressed-air feeds 36*a* of the former 36. Such a former 36 with feeds for compressed air is already known from DE 44 35 528 A1.

The invention is not limited by the embodiments described above which are presented as examples only but can be modified in various ways within the scope of protection defined by the appended patent claims.

I claim:

1. A web-fed rotary printing machine including a printing unit, a dryer, and a cooling unit, and a folding device arranged downstream of the cooling unit, said folding device comprising:

a turner-bar structure;

a folding unit; and plurality of rollers for guiding and feeding a printing-material web along a path through said turner-bar structure and to said folding unit, at least one of said plural rollers comprising a coolant roller operatively designed for conducting a coolant medium, wherein said folding device stands apart from the cooling unit in the web-fed rotary printing machine so that said coolant roller of said folding device effects a second step of a cooling process of the printing-material web.

2. The printing machine of claim 1, wherein said coolant medium comprises one of a fluid medium and cooled compressed air.

3. The printing machine of claim 1, said folding device further comprising a former having a cooling arrangement for feeding cooled compressed air onto a surface of the printing-material web.

4. The printing machine of claim 1, wherein one of said plurality of rollers of said folding device comprises a feed roller and another one of said plurality of rollers comprises a pressure-exerting roller for interacting with said feed roller, wherein each said pressure-exerting roller and said feed roller comprises a cooling roller.

5. The printing machine of claim 1, wherein said turner-bar structure of said folding device comprises one of a turner bar and an angle bar and said one of a turner bar and an angle bar comprises a cooling roller.

6. In a web-fed rotary printing machine including a printing unit, a dryer, and a cooling unit, a folding device arranged downstream of the cooling unit and comprising:

a turner-bar structure;

a folding unit;

a plurality of rollers for guiding and feeding a printing-material web having two opposing sides along a path through said turner-bar structure and to said folding unit; and a cooling arrangement operatively arranged in said folding device along the path of the printing-material web for feeding a first cooling medium to said two opposing sides of said printing material web.

7. The printing machine of claim 6, wherein said coolant medium comprises cooled compressed air.

8. The printing machine of claim 6, the folding device further comprising a former having a cooling arrangement for feeding cooled compressed air onto a surface of the printing-material web.

9. The printing machine of claim 6, wherein one of said plurality of roller of said folding device comprises a feed roller and another one of said plurality of rollers comprises a pressure-exerting roller for interacting with said feed roller, wherein each said pressure-exerting roller and said feed roller comprises a cooling roller operatively designed for conducting a second cooling medium.

10. The printing machine of claim 6, wherein said turner-bar structure of said folding device comprises one of a turner bar and an angle bar and said one of a turner bar and an angle bar comprises a cooling roller operatively designed for conducting a second cooling medium.

11. The printing machine of claim 6, wherein at least one of said plurality of rollers of said folding device comprises a coolant roller operatively designed for conducting a second coolant medium.

12. A cooling process for cooling a printing-material web that has been printed in printing units of a web-fed printing machine, dried in a dryer and preliminarily cooled in a cooling unit, comprising the steps of:

receiving the printing-material web from the cooling unit at a folding device and guiding the printing-material web received from the cooling unit through the folding device of the web-fed printing machine; and performing a second cooling step of a cooling process by cooling the printing-material web within the folding device using a cooling arrangement arranged in the folding device comprising one of a cooling roller for conducting a first cooling medium and a cooling arrangement for feeding a second cooling medium to the printing-material web, such that no printing ink comes away from the printing material web in the folding device.

13. The cooling process of claim 12, wherein said step of cooling the printing-material web comprises cooling the printing-material web to a temperature below 30° C.

* * * * *